US007775912B2

(12) United States Patent
Aguirre

(10) Patent No.: US 7,775,912 B2
(45) Date of Patent: Aug. 17, 2010

(54) SOCCER TRAINING DEVICE

(76) Inventor: Javier R. Aguirre, 47 Mount Pleasant Turnpike, Denville, NJ (US) 07834

( * ) Notice: Subject to any disclaimer, the term of this patent is extended or adjusted under 35 U.S.C. 154(b) by 268 days.

(21) Appl. No.: 12/152,421

(22) Filed: May 14, 2008

(65) Prior Publication Data

US 2009/0286630 A1 Nov. 19, 2009

(51) Int. Cl.
*A63B 69/00* (2006.01)

(52) U.S. Cl. ..... 473/423

(58) Field of Classification Search ..... 473/417, 473/419, 420, 423, 446
See application file for complete search history.

(56) References Cited

U.S. PATENT DOCUMENTS

| | | | | | |
|---|---|---|---|---|---|
| 808,528 | A | * | 12/1905 | Finney | 482/90 |
| 3,351,343 | A | | 11/1967 | Papp | |
| 3,498,613 | A | | 3/1970 | Dreyer | 273/95 |
| 3,874,662 | A | | 4/1975 | Harrington | 273/26 |
| 4,147,353 | A | | 4/1979 | Moore | 273/95 |
| 4,258,916 | A | * | 3/1981 | Beam | 473/429 |
| 4,307,888 | A | | 12/1981 | Ohle | 273/413 |
| 4,561,661 | A | * | 12/1985 | Walker et al. | 473/423 |
| 4,576,379 | A | | 3/1986 | Juhasz | 273/411 |
| 4,592,549 | A | | 6/1986 | Ryan | 273/58 |
| 4,616,834 | A | | 10/1986 | Davis | 273/411 |
| 4,664,374 | A | * | 5/1987 | Groves | 473/417 |
| 4,830,371 | A | * | 5/1989 | Lay | 473/423 |
| 4,938,478 | A | * | 7/1990 | Lay | 473/423 |
| 5,037,113 | A | * | 8/1991 | Sowards | 473/423 |
| 5,280,922 | A | | 1/1994 | Jones | 273/411 |
| 5,393,050 | A | * | 2/1995 | Lloyd | 473/429 |
| 5,620,186 | A | | 4/1997 | Dudley | 473/423 |
| 5,951,414 | A | * | 9/1999 | Sowards | 473/423 |
| 5,957,789 | A | | 9/1999 | Ainscough et al. | 473/423 |
| 6,152,838 | A | | 11/2000 | Killion | 473/424 |
| 6,168,539 | B1 | | 1/2001 | Maina | 473/424 |
| 6,220,974 | B1 | | 4/2001 | Moore | 473/430 |
| 6,475,108 | B1 | | 11/2002 | Sarenana, Sr. et al. | 473/420 |
| 6,551,204 | B1 | * | 4/2003 | Di Re | 473/417 |
| 6,659,891 | B2 | * | 12/2003 | Lloyd | 473/423 |
| 6,802,788 | B1 | | 10/2004 | Moushi et al. | 473/426 |
| 7,137,909 | B2 | | 11/2006 | Ohle | 473/423 |
| 7,186,192 | B1 | | 3/2007 | Suissa | 473/423 |
| 2002/0028716 | A1 | | 3/2002 | Gormley | 473/423 |
| 2003/0224880 | A1 | | 12/2003 | Hansberry | 473/430 |
| 2004/0254035 | A1 | | 12/2004 | Hoffman | 473/423 |

(Continued)

*Primary Examiner*—Alvin A Hunter
*Assistant Examiner*—M Chambers
(74) *Attorney, Agent, or Firm*—Watov & Kipnes, P.C.; Kenneth Watov

(57) ABSTRACT

A soccer training device for enhancing ball-handling and physical coordination of a soccer player, includes a base member, a rotary member, an elongated arm having a free distal end and a proximal end pivotally attached to a top portion of the base member via the rotary bearing, wherein the elongated arm is adapted for pivotal movement in at least one axis of direction about the point of attachment, an articulated member extending from the distal end of the elongated arm, wherein the articulated member is adapted for movement from a rest position in any axis of direction independent of the elongated arm, a biasing mechanism operatively associated with the articulated member for biasing the articulated member into alignment with the elongated arm, and a ball retaining member operatively associated with the free end of the articulated member for retaining a soccer ball thereon.

18 Claims, 11 Drawing Sheets

U.S. PATENT DOCUMENTS

2005/0272533 A1 12/2005 Ohle ..... 473/423
2006/0089213 A1 4/2006 Snyder ..... 473/435
2007/0026973 A1 2/2007 Johnson et al. ..... 473/423

* cited by examiner

SOCCER TRAINING DEVICE

FIELD OF THE INVENTION

The present invention relates generally to sports skill practice and training, and more specifically to a soccer training device for enhancing ball-handling and physical coordination of a soccer player.

BACKGROUND OF THE INVENTION

Sports provide an enjoyable and competitive outlet for many throughout the world. Sports are generally governed by a set of rules for establishing a game. The game typically utilizes a playing surface on which a player interacts with a game object such as a soccer ball in a manner to prevent an opponent from similarly handling the game object. Many sports require players to possess certain physical capabilities including good hand-eye or foot-eye coordination. Such physical capabilities are often the sole or primary determinant of the game's outcome. Sports have provided players with the opportunity to exercise their minds and bodies, to learn teamwork and sportsmanship, and to attain goals and objectives.

One universally popular and widely played sport is soccer, which is a game played between two teams of players on a rectangular playing surface with a goal guarded by a goaltender at each of the short ends. The object of the game is to score by maneuvering a soccer ball into the opposing goal. The goaltenders are the only players allowed to use any part of their body including their hands or arms to propel the soccer ball, while the rest of the team members usually use their feet, torso or head to move the soccer ball into position. The team that scores the most goals by the end of the match wins.

A soccer player's success in soccer is not related to any single attribute, but rather many attributes including, but not limited to, mental drive, muscle strength, endurance, coordination and balance. Only a select few players with superior skills have gone on to compete professionally in soccer. Thus, the desire to succeed in soccer has created a need among players to learn and develop their skills to their full potential to excel at their chosen sport. To achieve such goals, players have utilized training methods including specialized devices to learn and practice the required skills including ball handling and coordination. Ideally, such training methods should work toward developing and refining the soccer player's reflex speed, muscle strength, endurance, coordination and improved balance by training the nervous system and improving muscle responses.

Accordingly, there remains a need for a soccer training device that facilitates the practice of ball-handling and physical coordination in a soccer player. There further remains a need for a soccer training device that teaches ball-handling skills particularly with the feet and legs to develop better control of the soccer ball without having to look at the soccer ball. Use of such a device will encourage players to keep their heads up during game situations, resulting in improved ball handling abilities.

SUMMARY OF THE INVENTION

The present invention is generally related to a soccer training device for enhancing ball-handling and physical coordination of a soccer player. The soccer training device of the present invention is designed to present a soccer ball for interaction with the body of the soccer player. The soccer training device of the present invention is utilized by soccer players to allow the soccer player to practice kicking, tapping, dribbling, catching, and maneuvering the soccer ball with their head, torso, feet and/or legs. The soccer training device of the present invention allows the soccer ball to travel in a manner that replicates the natural flight path of a soccer ball before and after being kicked, while also permitting the soccer player to practice ball handling skills other than kicking. The soccer training device of the present invention provides a flexible training regimen, and can be used in solo training or with partners. The soccer training device is compact, lightweight and simple to assemble for enhanced portability and storage convenience, while remaining cost effective and easy to make and use. Its design permits it to be used either indoors or outdoors with a limited practice area or space.

In particular, the soccer training device includes an elongated arm pivotally attached to a base member for pivotal movement about at least one axis of direction. The elongated arm is adapted for retaining a soccer ball at the distal end thereof. The elongated arm further includes an articulated member positioned between the distal end of the elongated arm and the retained ball. The articulated member is adapted to selectively move in any axis of direction independent of the elongated arm, and also will absorb a portion of the kicked or applied force against the soccer ball to ease the pressure on the base member. The articulated feature of the device increases the range of motions of the soccer ball to provide enhanced ball handling training capabilities, such as dribbling of the soccer ball.

Optionally, the soccer training device includes a dampener for cushioning or dampening the flight path of the soccer ball after kicking and returning the soccer ball to the soccer player for continuous practice. The dampener further allows the soccer player to limit the extent of the soccer ball's flight path in a selectable and adjustable manner to further control the kickback.

In one aspect of the present invention, there is provided a soccer training device for enhancing ball-handling and physical coordination of a soccer player, which comprises:

a base member;

a rotary bearing;

an elongated arm having a free distal end and a proximal end pivotally attached to a top portion of the base member via the rotary bearing, the elongated arm adapted for pivotal movement in at least one axis of direction about the point of attachment;

an articulated member extending from the distal end of the elongated arm, the articulated member adapted for movement from a rest position in any axis of direction independent of the elongated arm;

biasing means operatively associated with the articulated member for biasing the articulated member into alignment with the elongated arm; and ball retaining means operatively associated with the free end of the articulated member for retaining a soccer ball thereon.

In a further aspect of the present invention, there is provided a soccer training device for enhancing ball-handling and physical coordination of a soccer player, which comprises:

a circular base member having a selectively sealable opening in communication with a hollow portion thereof for receiving an amount of a flowable material to weigh down the base member;

a rotary bearing;

an elongated arm having a free distal end and a proximal end pivotally attached to a top portion of the base member via the rotary bearing, the elongated arm adapted for pivotal movement in select axis of direction about the point of attachment to provide a range of motion of about 180 degrees in the vertical plane;

an articulated member extending from the distal end of the elongated arm, the articulated member adapted for movement from a rest position in any axis of direction independent of the elongated arm;

biasing means operatively associated with the articulated member for biasing the articulated member into alignment with the elongated arm; and ball retaining means operatively associated with the free end of the articulated member for retaining a soccer ball thereon.

BRIEF DESCRIPTION OF THE DRAWINGS

Various embodiments of the invention are described in greater detail below with reference to the drawings, in which like terms are identified by the same reference designation, wherein.

DETAILED DESCRIPTION OF THE INVENTION

Figure 1:
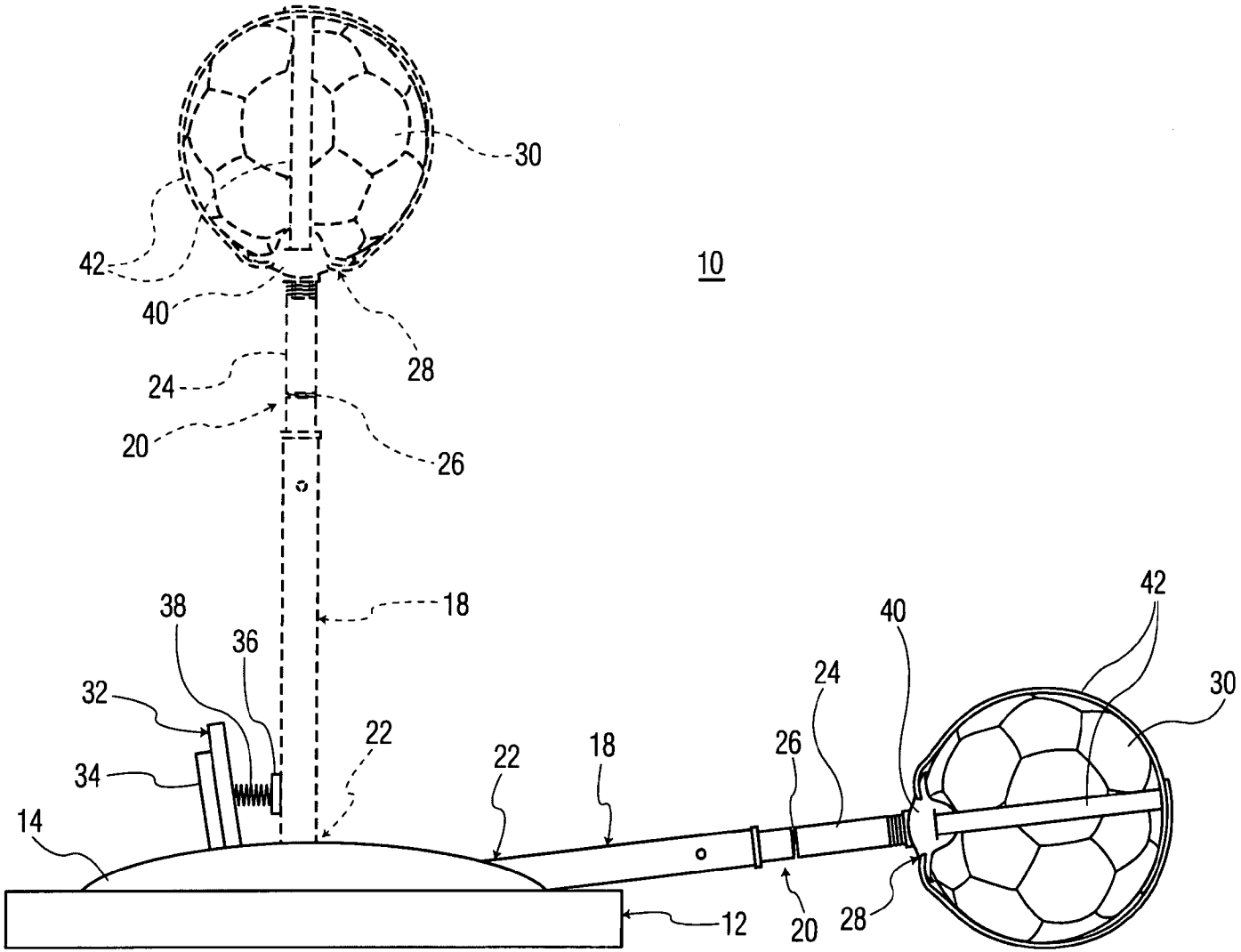
FIG. 1 is a side elevational view of a soccer training device with a dampener for one embodiment of the present invention.

The present invention is directed generally to a soccer training device for enhancing ball-handling and physical coordination of a soccer player. The soccer training device of the present invention is designed to present a soccer ball for interaction with the body of the soccer player. The soccer training device of the present invention is utilized by soccer players to allow the soccer player to practice kicking, tapping, dribbling, catching, and maneuvering the soccer ball with their head, torso, feet and/or legs. The soccer training device of the present invention allows the soccer ball to travel in a manner that replicates the natural flight path of a soccer ball before and after being kicked, while also permitting the soccer player to practice ball handling skills other than kicking. The soccer training device of the present invention provides a flexible training regimen, and can be used in solo training or with partners. The soccer training device is compact, lightweight and simple to assemble for enhanced portability and storage convenience, while remaining cost effective and easy to make and use. Its design permits it to be used either indoors or outdoors with a limited practice area or space.

In particular, the soccer training device includes an elongated arm pivotally attached to a base member for pivotal movement about at least one axis of direction. The elongated arm is adapted for retaining a soccer ball at the distal end thereof. The elongated arm further includes an articulated member positioned between the distal end of the elongated arm and the retained ball. The articulated member is adapted to selectively move in any axis of direction independent of the elongated arm, and also will absorb a portion of the kicked or applied force against the soccer ball to ease the pressure on the base member. The articulated feature of the device increases the range of motions of the soccer ball to provide enhanced ball handling training capabilities, such as dribbling of the soccer ball.

Optionally, the soccer training device includes a dampener for cushioning or dampening the flight path of the soccer ball after kicking and returning the soccer ball to the soccer player for continuous practice. The dampener further allows the soccer player to limit the extent of the soccer ball's flight path in a selectable and adjustable manner to further control the kickback.

In one embodiment of the present invention, there is provided a soccer training device for enhancing ball-handling and physical coordination of a soccer player, which includes a base member, a rotary member, an elongated arm having a free distal end and a proximal end pivotally attached to a top portion of the base member via the rotary bearing, wherein the elongated arm is adapted for pivotal movement in at least one axis of direction about the point of attachment, an articulated member extending from the distal end of the elongated arm, wherein the articulated member is adapted for movement from a rest position in any axis of direction independent of the elongated arm, biasing means operatively associated with the articulated member for biasing the articulated member into alignment with the elongated arm, and ball retaining means operatively associated with the free end of the articulated member for retaining a soccer ball thereon.

Referring to FIG. 1, a portable soccer training device identified generally by reference numeral 10 is shown for one embodiment of the present invention. The soccer training device or device 10 is designed to allow a soccer player to interact with a soccer ball in a manner that substantially simulates the actions and the natural flight path of the soccer ball during playing conditions. The device 10 is designed to teach ball-handling skills particularly with the feet and legs to develop better control of the soccer ball without having to look at the soccer ball. Use of the device 10 encourages players to keep their heads up during game situations, resulting in improved ball handling abilities. The device 10 includes a circular base member 12 having a top or raised portion 14 with a groove 16 extending laterally therethrough (as shown best in FIG. 2), and an elongated arm 18 with a free distal end 20 and a proximal end 22 pivotally attached to the center of the base member 12 via a rotary bearing 23 (see FIG. 4). The arm 18 is adapted for pivotal movement in at least one axis of direction about the point of attachment to the rotary bearing 23.

The device 10 includes an articulated member 24 extending from the distal end 20 of the elongated arm 18, which is adapted for movement in any axis of direction independent of the elongated arm 18, and a spring biased mechanism 26 operatively associated with the articulated member 24 for biasing the articulated member 24 into alignment with the elongated arm 18. The device 10 further includes a soccer ball retaining mechanism 28 operatively associated with the free end of the articulated member 24 for retaining a soccer ball 30 thereon.

The ball retaining mechanism 28 includes a platform 40 threadedly engaged to the threaded free end of the articulated member 24, and a plurality of straps 42 extending from the platform 40, and adapted for enclosing and securely retaining the soccer ball 30 on the platform 40. In the present embodiment, the straps 42 are in the form of hook and loop fastener strips such as VELCRO™. The ball retaining mechanism 28 can accommodate soccer balls such as professional match balls, match balls, practice/camp balls, promotional balls, indoor balls, futsal balls and the like, which may range from size 3 to size 5.

As shown in FIG. 1, the elongated arm 18 is adapted to rotatably move via the rotary bearing 23 from a rest position (shown in solid) to a non-rest position (as shown in phantom). The movement of the elongated arm 18 with the soccer ball 30 attached thereon, imparts a more natural arc-like flight path for the soccer ball 30 after being kicked or propelled by the soccer player. In the one embodiment, the elongated arm 18 is rotatable about almost 180 degrees in a vertical plane relative to the base member 12 (see FIG. 2). The elongated arm 18 can be adjusted telescopically to change the curvature radius and height of the flight path of the soccer ball 30 based on the soccer player preferences as will be described hereinafter.

Figure 2:
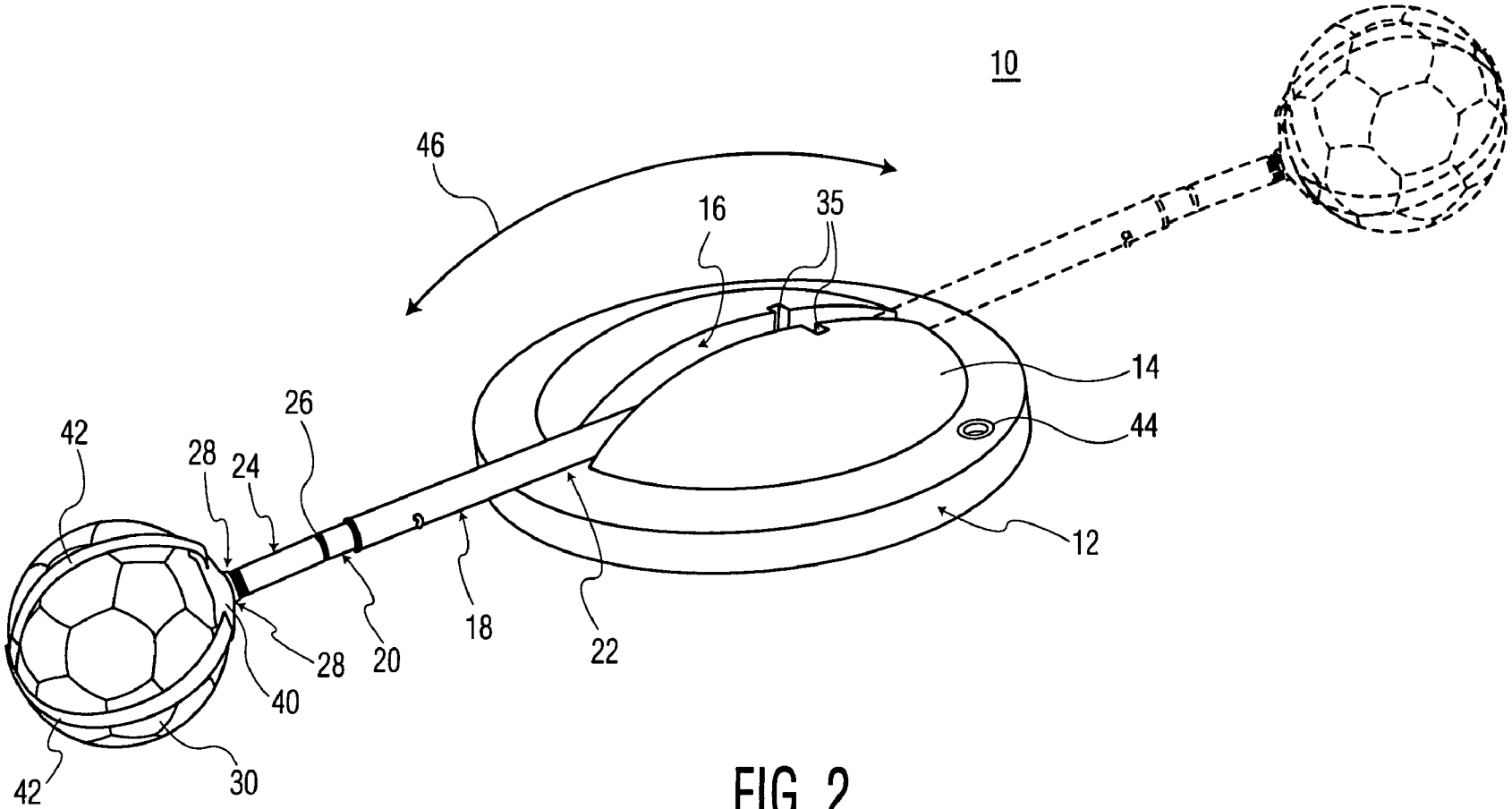
FIG. 2 is a perspective view of the soccer training device absent the dampener in accordance with the present invention.
Figure 3:
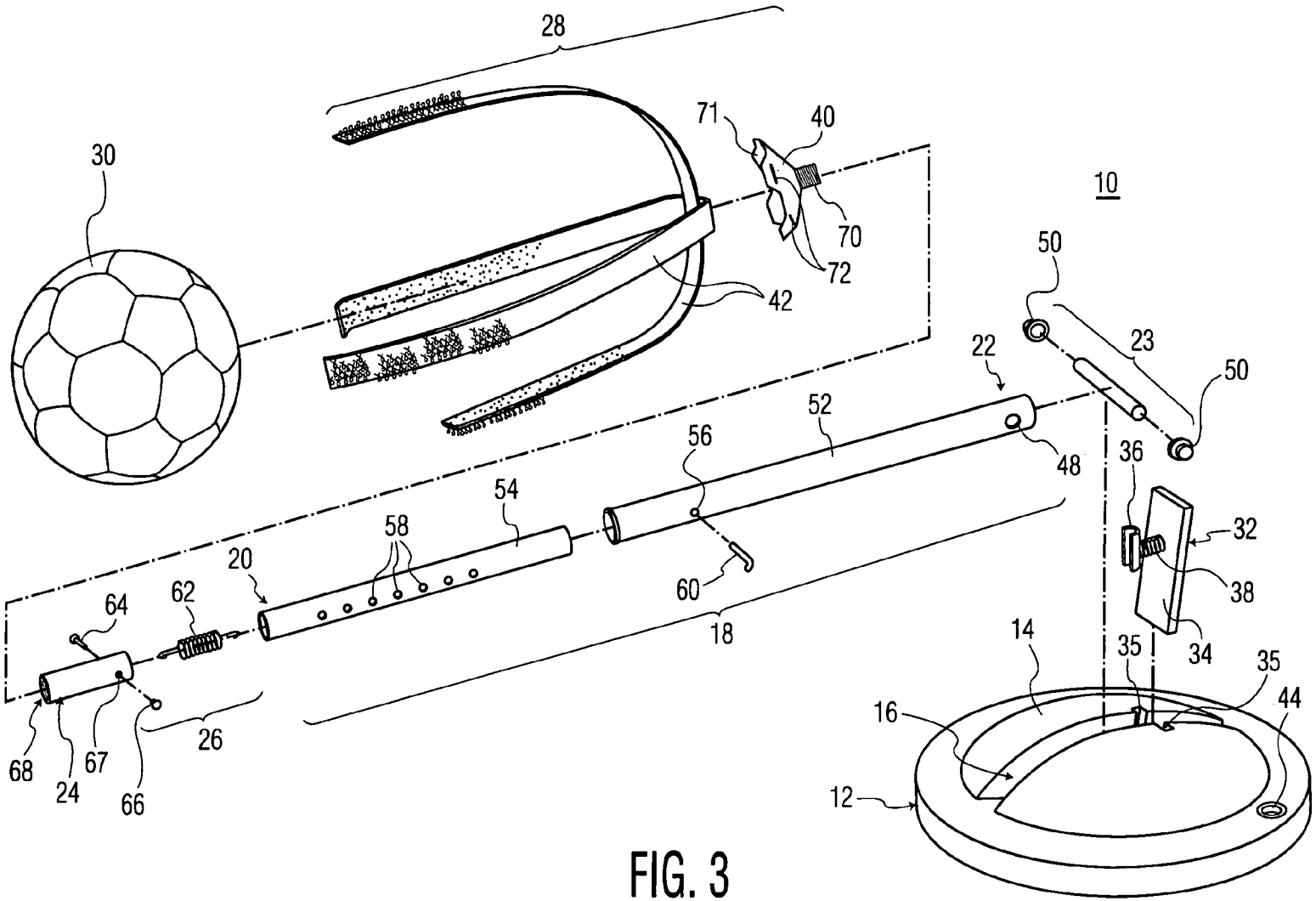
FIG. 3 is an assembly view of the soccer training device of FIG. 1 in accordance with the present invention.

The device 10 includes a dampener 32 removably mounted in the top portion 14 of the base member 12. The device 10 can be configured to permit the dampener 32 to be selectively positioned along a plurality of spaced apart intermediate points of the path of movement of the elongated arm 18. In the present embodiment as shown in FIGS. 1 through 3, the dampener 32 is positioned to limit the range of movement of the elongated arm 18 to about 90 degrees from horizontal. The dampener 32 includes a mounting member 34 adapted for mounting into a transverse slot 35 (as shown in FIG. 3) of the top portion 14 of the base member 12, a strike plate 36 positioned to receive the elongated arm 18 in the non-rest position, and a compressive spring 38 positioned between the mounting member 34 and the strike plate 36 for dampening and dissipating any force imparted from the elongated arm 18 after the soccer player kicks the soccer ball 30. In this manner, the dampener 32 dissipates the kinetic energy and slows the forward and rebound movement of the elongated arm 18 and the soccer ball 30 prior to returning the soccer ball 30 back to the rest position.

As described above, the articulated member 24 can move in any axis of direction independent of the elongated arm 18. The spring biased mechanism 26 urges the articulated member 24 to a normally resting position in alignment with the longitudinal axis of the elongated arm 18. Also, the spring biased mechanism 26 provides for dampening of the kick force upon the soccer ball 30. The free movement of the articulated member 24 during use allows the soccer player to manipulate the soccer ball 30 in a manner that enhances the practicing of ball-handling with their feet and/or legs including tapping, dribbling, catching, and maneuvering the soccer ball 30. In addition, the articulated member 24 can cause the soccer ball 30 to exhibit a wobble or bobbing effect as it travels along the flight path. This compels the soccer player to consciously focus on the position and momentum of the soccer ball 30 as it moves, thus training and improving the soccer player's ball-handling footwork and reflex response.

Referring to FIG. 2, the circular base member 12 further includes a closable opening 44 in communication with a hollow portion (not shown) thereof for receiving and retaining a volume of a flowable substance, such as, for example, water or sand to provide sufficient weight and stability to the device 10 and prevent tipping during use. The flowable substance can be selected from a liquid, a particulate solid or combinations thereof. The flowable substance can be removed through the opening 44 to reduce the weight of the device 10 for transport and/or storage, thereby providing greater portability. The dampener 32 can be removed to increase the range of movement 46 of the elongate arm 18 and the soccer ball 30 up to about 180 degrees in the vertical plane relative to the base member 12. In this manner, the device 10 permits the soccer player to train with a partner, who can be suitably positioned at the opposite side.

Figure 4:
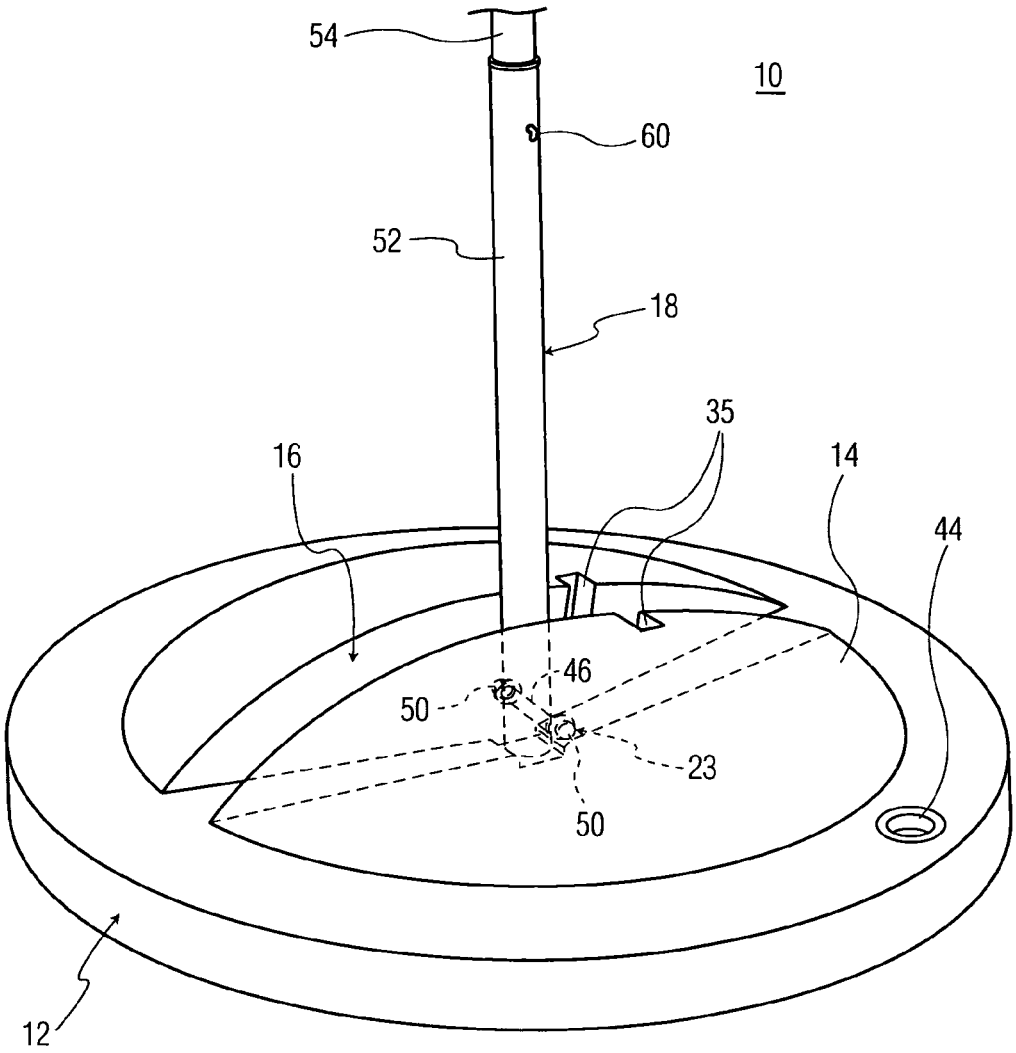
FIG. 4 is a partial perspective view of the soccer training device with a rotary bearing shown in phantom in accordance with the present invention.
Figure 5:
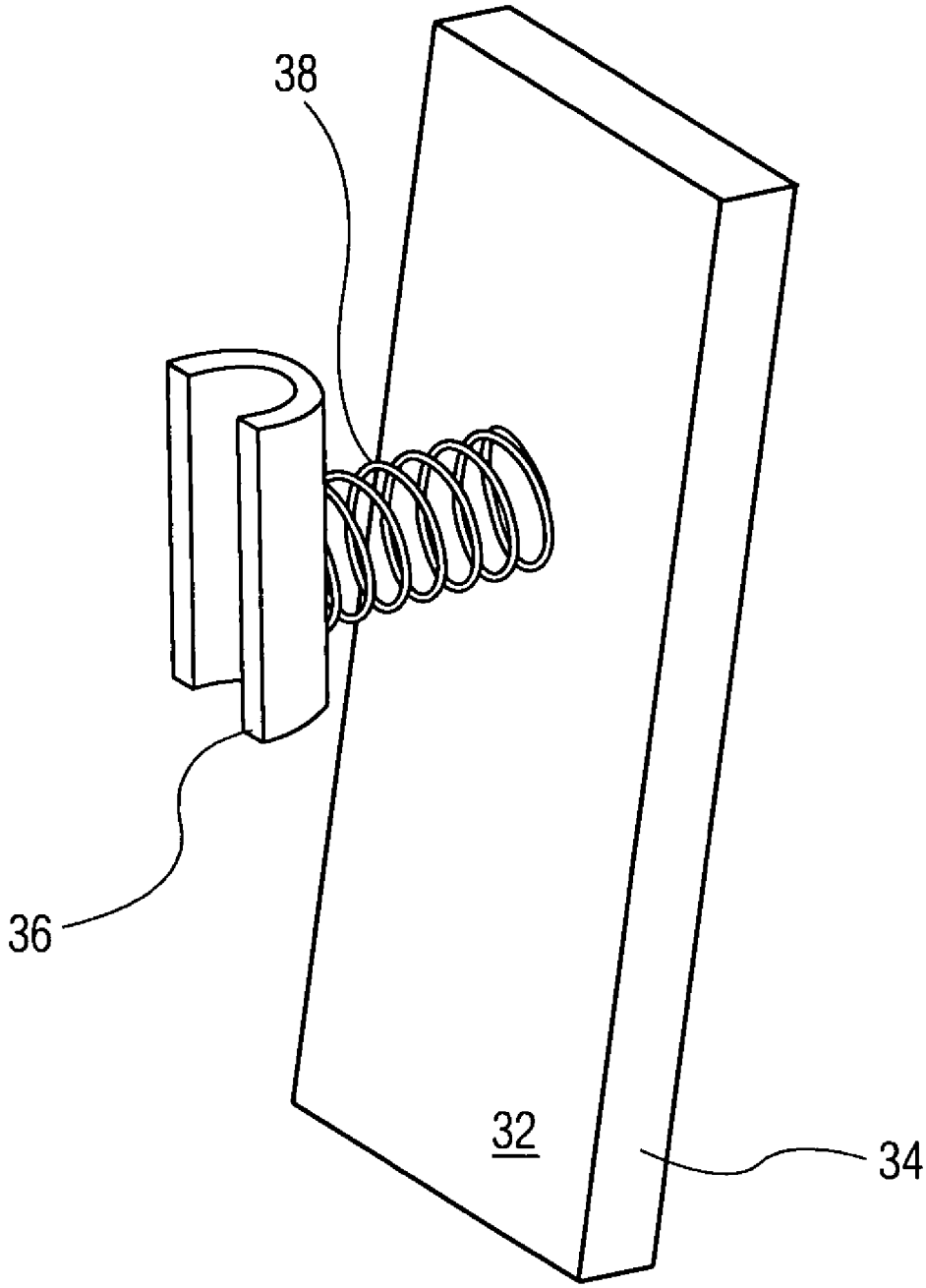
FIG. 5 is a perspective view of the dampener of FIG. 1 in accordance with one embodiment of the present invention.

Referring to FIGS. 3 and 4, the circular base member 12 is placed on a firm, level surface preferably a non-slip surface. The dampener 32 is removably inserted into the slot 35, and oriented with the strike plate 36 facing the elongated member 18. The elongated arm 18 is rotatably connected to the base member 12 via the rotary bearing 23. The rotary bearing 23 includes a spindle or axle 46 extending through an aperture or throughhole 48 in the proximal end 22 of the elongated arm 18, and a pair of opposed end caps 50 mounted in the top portion 14 for captively retaining the spindle 46 therebetween within and transverse to the groove 16 of the base member 12 as shown best in FIG. 4. The elongated arm 18 is free to rotate about the spindle 46.

The elongated arm 18 is composed of an outer proximal tube 52, which forms an outer sleeve for receiving and slidably retaining an inner distal tube 54 to provide a telescoping feature therebetween. As shown in FIG. 3, the outer proximal tube 52 includes a set pin 60 and a set aperture 56 for receiving and retaining the set pin 60. The inner distal tube 54 includes a plurality of spaced apart adjustment holes 58 positioned along the length thereof. The desired length of the elongated arm 18 can be adjusted through extension or retraction of the inner distal tube 54 into the outer proximal tube 52, and alignment of the set aperture 56 with the corresponding adjustment hole 58. The set pin 60 is then inserted into the set aperture 56 and the adjustment hole 58 to fix the length of the elongated arm 18.

The articulated member 24 includes a tubular structure with one end abutting against the distal end 20 of the elongated arm 18 and retained in position by the spring biased mechanism 26. The spring biased mechanism 26 includes a tension spring 62 with one end attached to the inner distal tube 54 via an internal stud (not shown), and the other end attached to the articulated member 24 via engagement with an arm of a bolt 64 pushed through holes 67 on opposite sides of the articulated member 24, with the bolt 64 being secured by a nut 66. The internal stud in tube 54 can be similarly provided by a nut and bolt 64, 66, respectively. The resulting construction permits the articulated member 24 to move freely about the spring biased mechanism 26, when a force is applied laterally or transversely to the free end 68 of the articulated member 24. The tension produced by the spring 62 ensures that the articulated member 24 is biased to a rest position in alignment with the longitudinal axis of the elongated arm 18. The free end 68 of the articulated member 24 is internally threaded (provides a female socket) to receive and threadedly engage with the ball retaining mechanism 28 as will be described.

With reference to FIG. 3, the platform 40 of the ball retaining mechanism 28 includes an upper portion 71 suitably shaped to retain a portion of the soccer ball 30 removably affixed thereto, an externally thread projection 70 extending therefrom for threaded engagement with female socket of the free end 68 of the articulated member 24, and a plurality of slots 72 for receiving and retaining individual ones of the plurality of straps 42 thereon. The soccer ball 30 is securely retained to the elongated arm 18 through fastening engagement with the straps 42, as shown in FIGS. 1 and 2, for example.

Figure 6:
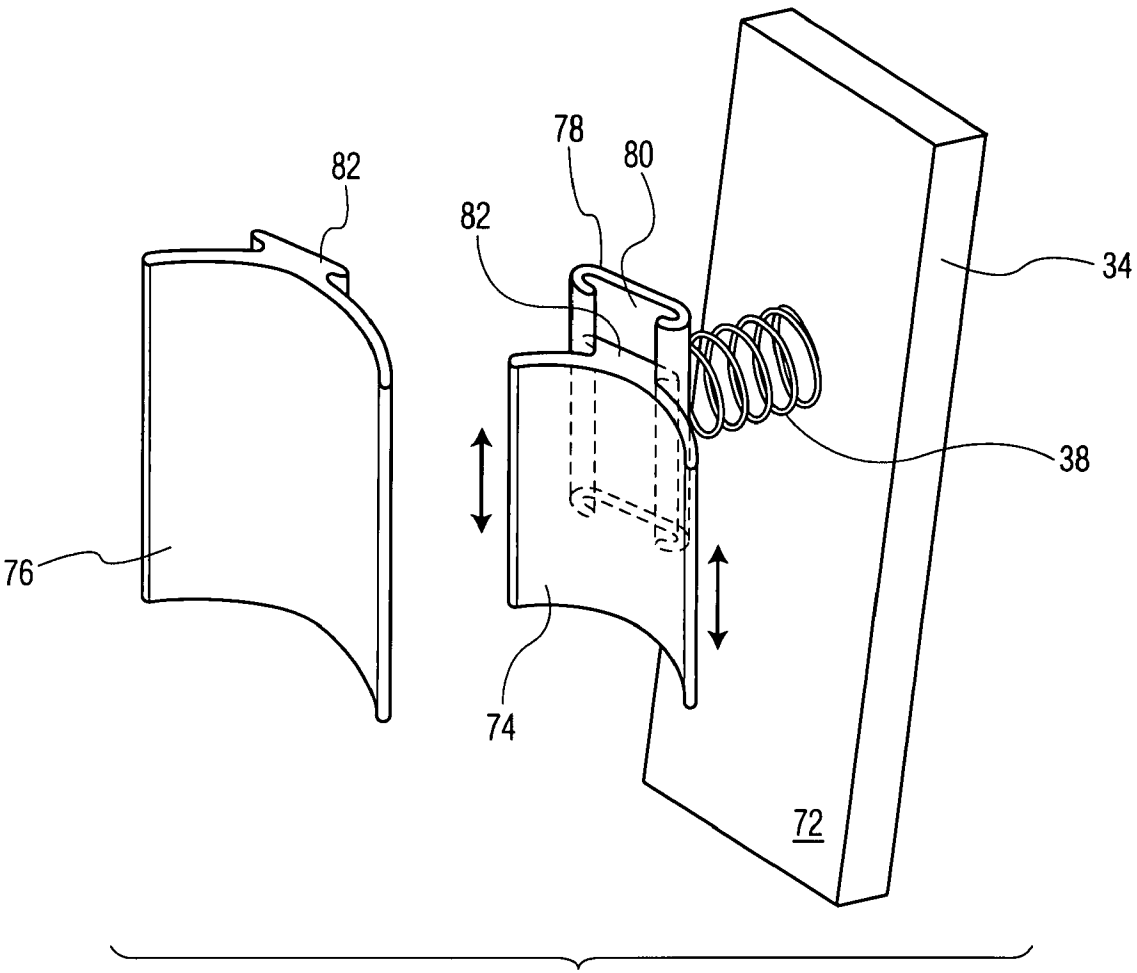
FIG. 6 is a perspective view of a dampener for another embodiment of the present invention.

Referring to FIG. 6, a dampener 72 is shown for another embodiment of the present invention. The dampener 72 is similar in most features to the dampener 32 described above. The dampener 72 includes a removable strike plate 74 that can be interchanged with a different removable strike plate 76, and a strike plate holder 78 attached to the spring 28. The strike plate holder 78 is configured to form a retaining slot 80 that is shaped to slidably receive and retain a complementarily shaped plug 82 of the strike plates 74 or 76.

Figure 7:
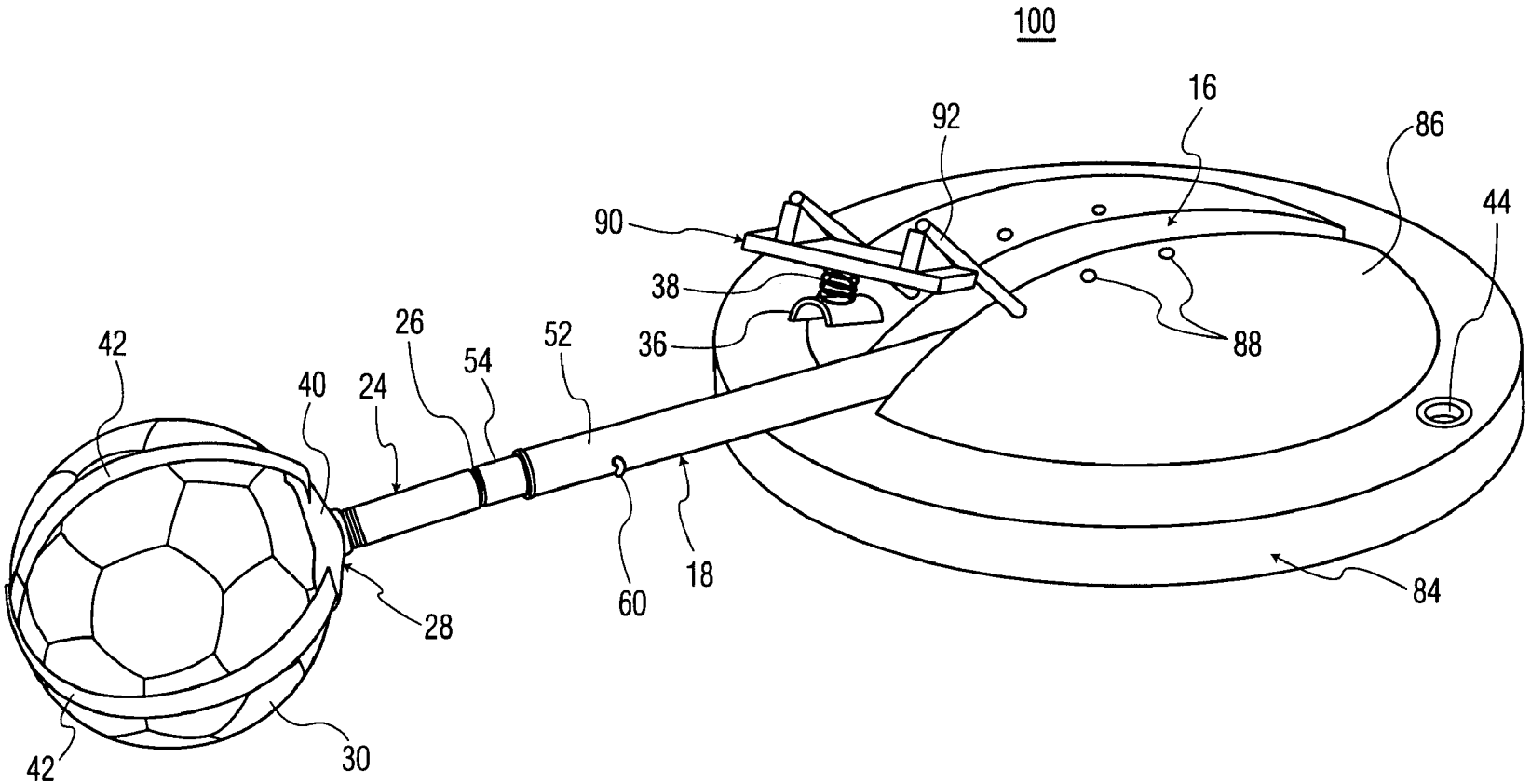
FIG. 7 is a perspective view of a soccer training device for a second embodiment of the present invention.
Figure 8:
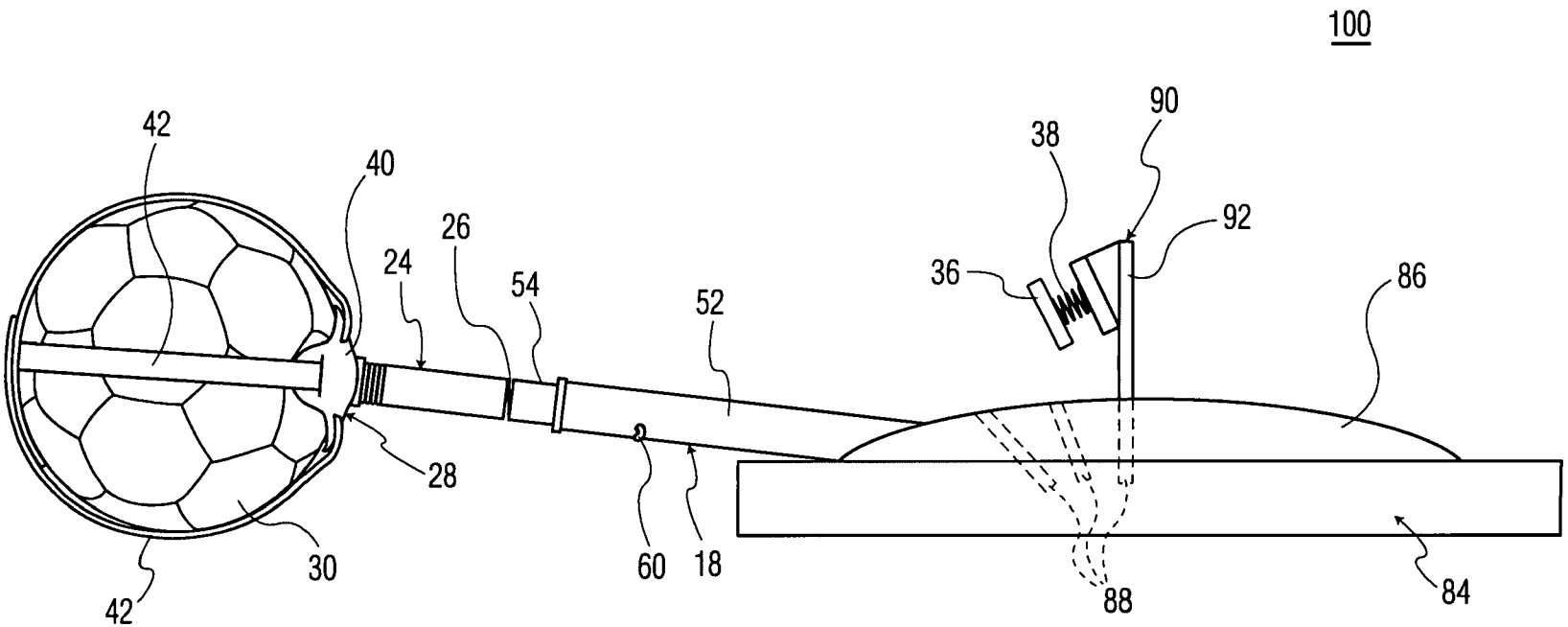
FIG. 8 is a side elevational view of the soccer training device of FIG. 7 in accordance with the present invention.

Referring to FIGS. 7 and 8, a soccer training device 100 is shown for another embodiment of the present invention. The soccer training device 100 is similar in most features to the soccer training device 10. The soccer training device 100 includes a base member 84 having a top portion 86 with a plurality of spaced apart adjustment holes 88 disposed along the groove 16. The plurality of adjustment holes 88 are adapted to receive and retain a dampener 90 at selected positions along the movement path of the elongated arm 18 (as shown in FIG. 8). This allows the soccer player to set the range of movement of the elongated arm 18 and the soccer ball 30 as desired. The dampener 90 includes a mounting portion 92 adapted to fit into the corresponding adjustment holes 88.

Figure 9:
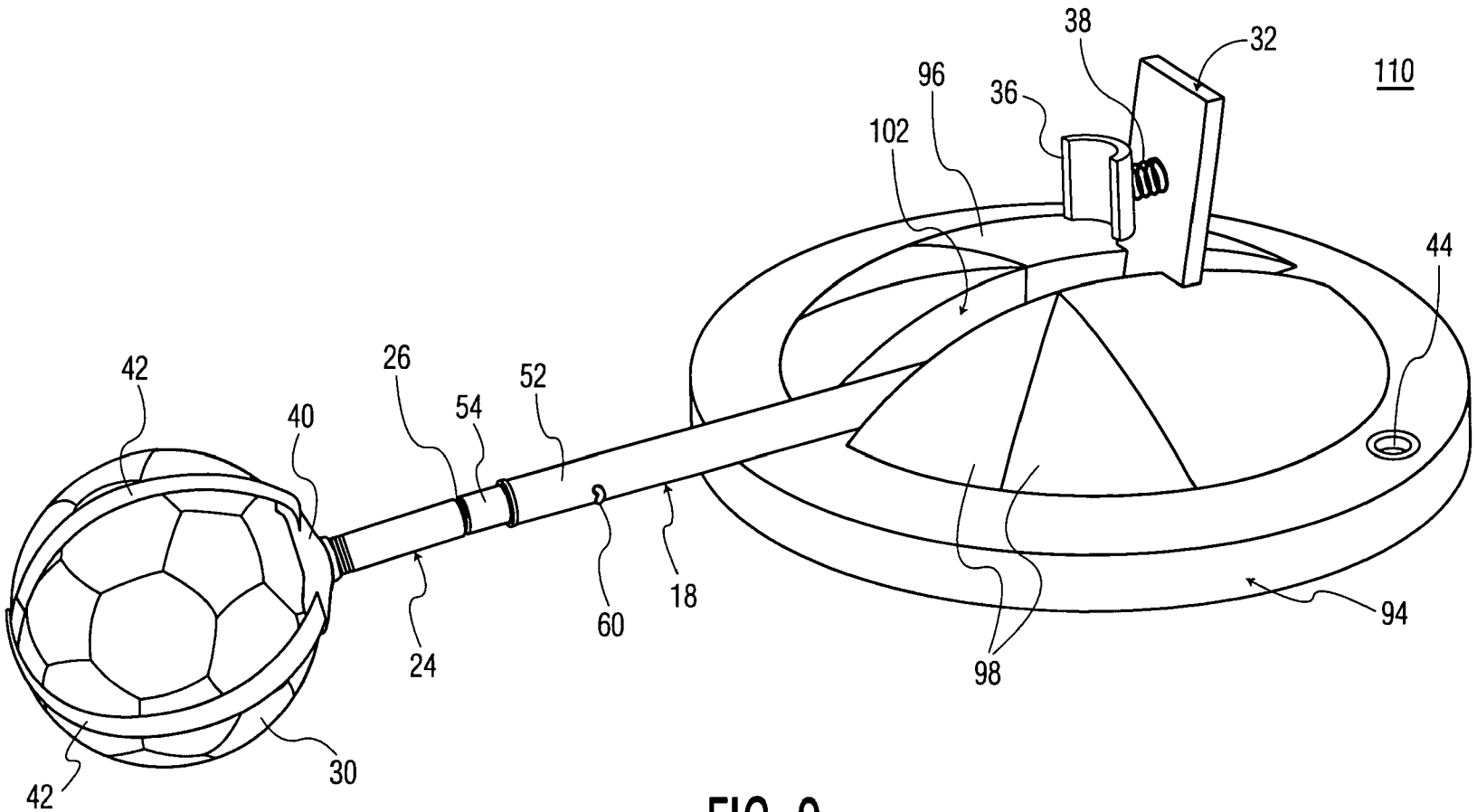
FIG. 9 is a perspective view of a soccer training device for a third embodiment of the present invention.
Figure 10:
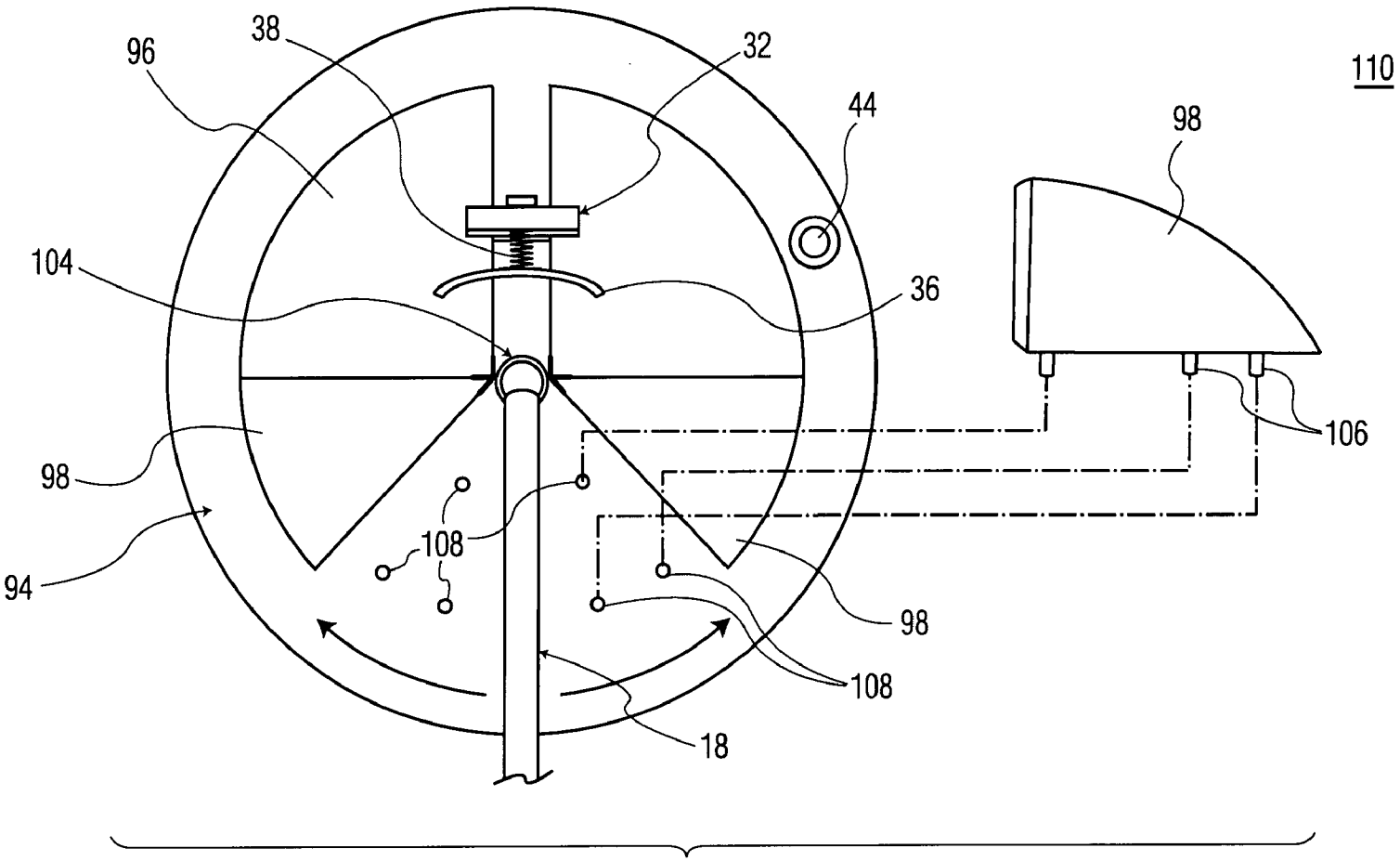
FIG. 10 is partial top plan view of the soccer training device of FIG. 9 in accordance with the present invention.
Figure 11:
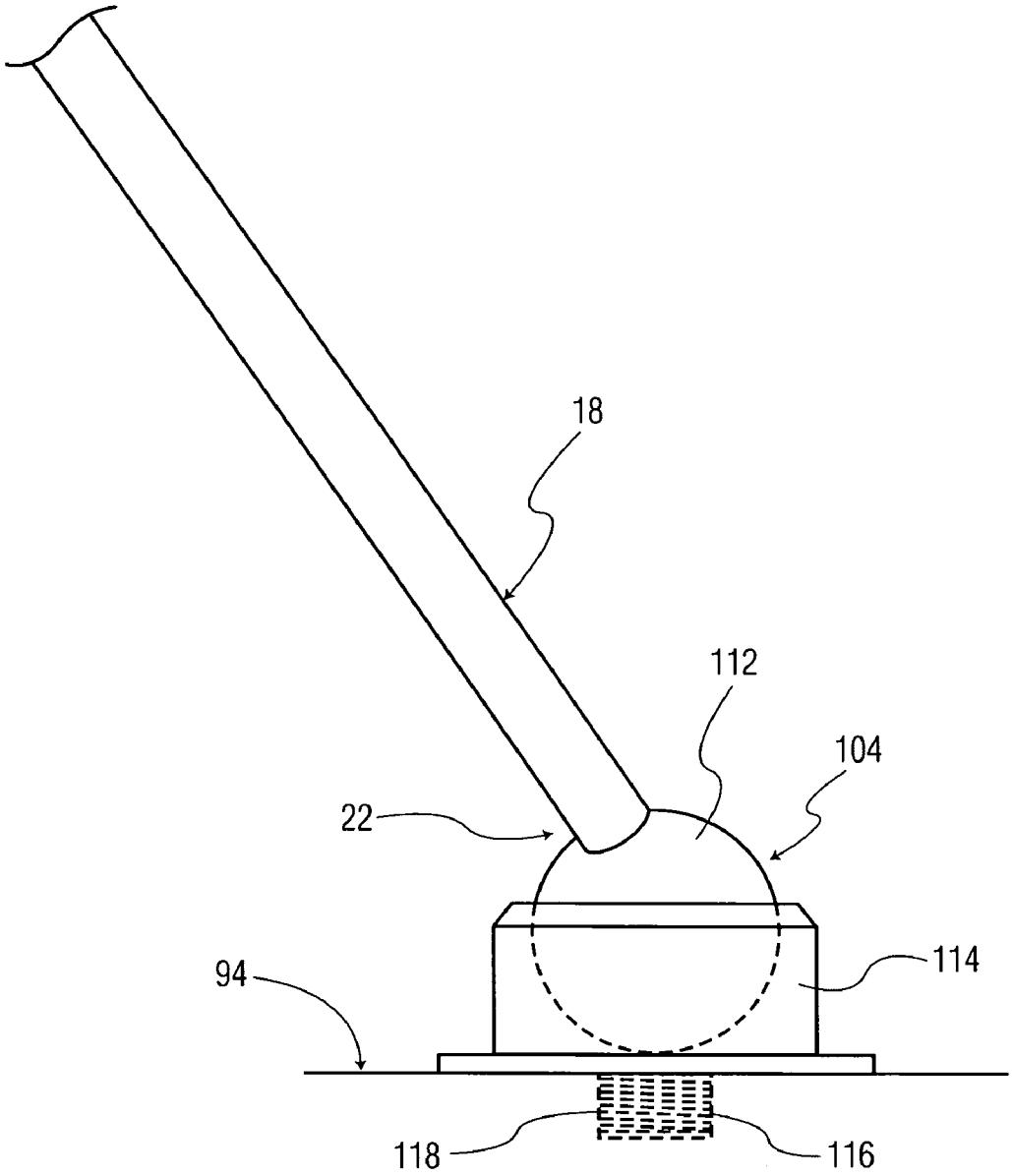
FIG. 11 is an elevational view of a rotary bearing of the soccer training device for another embodiment of the present invention.

Referring to FIGS. 9, 10 and 11, a soccer training device 110 is shown for another embodiment of the present invention. The soccer training device 110 is similar in most features to the soccer training device 10. The device 110 includes a base member 94 having a top or raised portion 96 defining a groove 102 extending therethrough, and the elongated arm 18 pivotally attached to the center of the base member 94 via a rotary bearing 104 (see FIGS. 10 and 11) in the form of a ball joint, which is adapted for pivotal movement in any axis of direction about the point of attachment. The ball joint rotary bearing 104 permits the elongated arm 18 and the soccer ball 30 to travel in different directions as will be described hereinafter. However, the movement of the elongated arm 18 and the soccer ball 30 is limited by the groove 102 to about 180 degrees in a vertical plane relative to the base member 96.

As shown in FIG. 10, the top portion 96 of the base member 94 includes a plurality of removable wedge members 98 disposed adjacent to the elongated arm 18. The wedge members 98 are retained on the base member 94 through insertion of three plugs 106 extending from the bottom thereof into the corresponding sockets 108 of the base member 94. The removal of one or more of the wedge members 98 allows the elongated arm 18 and the soccer ball 30 to move in both the vertical and the horizontal planes. This permits a greater range of motion for the soccer player to train with the soccer ball 30. As shown in FIG. 11, the rotary bearing 104 in the form of a ball joint includes a ball portion 112 attached to the proximal end 22 of the elongated arm 18, and a socket portion 114 adapted to receive and captively retain the ball portion 112. The ball portion 112 rotates freely within the socket portion 114 to provide rotary motion to the elongated arm 18. The socket 114 includes an externally threaded stud 116 that is threadedly engaged to an internally threaded hole 118 of the base member 94 for securing attachment therebetween.

Although various embodiments of the invention have been shown and described, they are not meant to be limiting. Those of skill in the art may recognize various modifications to these embodiments, which modifications are meant to be covered by the spirit and scope of the appended claims. For one example, rather than use the dampener 32, as described above, a pair of expansion springs attached between the elongated arm 18, and front portions of the base member 12 on opposite sides of the groove 16, can provide the necessary dampening. Alternatively, the expansion springs can be replaced by a single or pair of elongated bands of appropriate elastic material.

What is claimed is:

1. A soccer training device for enhancing ball-handling and physical coordination of a soccer player, comprising:

a base member;

a rotary bearing;

an elongated arm having a free distal end and a proximal end pivotally attached to a top portion of the base member via said rotary bearing, said elongated arm adapted for pivotal movement in at least one axis of direction about the point of attachment;

an articulated member extending from the distal end of the elongated arm, said articulated member adapted for movement from a rest position in any axis of direction independent of the elongated arm;

biasing means operatively associated with the articulated member for biasing the articulated member into alignment with the elongated arm; and ball retaining means operatively associated with the free end of the articulated member for retaining a soccer ball thereon wherein the elongated arm is configured for movement in a single vertical axis relative to the base member and said soccer training device also having a dampener positioned on the top portion of the base member along an intermediate point of a path of movement of the elongated arm, said dampener being adapted for dampening a forward movement, and a return movement of said elongated arm toward the rest position; said dampener including: a selectively removable mounting member adapted for mounting on the top portion of the base member; a compressive spring; and a strike plate in position for receiving the elongated arm, said strike plate being resiliently attached to the mounting member via said compressive spring, for dampening and dissipating a force imparted on the strike plate by said elongated arm.

2. The soccer training device of claim 1, wherein the top portion of the base member further comprises a raised area defining a groove extending laterally across the top portion thereof in alignment with the path of movement of the elongated arm, wherein the rotary bearing of the elongated arm is located at an intermediate point of the groove.

3. The soccer training device of claim 2, wherein the raised area of said base member further comprises at least one removable section to permit lateral movement of the elongated arm in the horizontal plane relative to the base member.

4. The soccer training device of claim 3, wherein said removable section is wedge-shaped.

5. The soccer training device of claim 4, wherein said removable section has a bottom portion which are rigidly mounted on a plurality of spaced apart downwardly providing plugs for retention in a plurality of similarly spaced apart sockets or holes on a top portion of said base member.

6. The soccer training device of claim 1, wherein the rotary bearing is selected from the group consisting of a hinge and a ball joint.

7. The soccer training device of claim 1, further comprising a dampener positioned on the top portion of the base member, said dampener being adapted for dampening the forward movement, and return movement of said elongated arm toward the rest position.

8. The soccer training device of claim 7, wherein the dampener comprises:

a selectively removable mounting member adapted for mounting on the top portion of the base member, along an intermediate point of the path of movement of the elongated arm;

a compressive spring; and a strike plate in position for receiving the elongated arm, said strike plate being resiliently attached to the mounting member via said compressive spring, for dampening and dissipating a force imparted on the strike plate by said elongated arm.

9. The soccer training device of claim 8, wherein the strike plate is removable from said mounting member.

10. The soccer training device of claim 1, wherein the ball retaining means comprises:

a platform configured for receiving a portion of a soccer ball, said platform being attached to the free end of the articulated member; and a plurality of straps operatively associated with the platform, said plurality of straps, adapted for enclosing and securely retaining the soccer ball on the platform.

11. The soccer training device of claim 10, wherein the plurality of straps comprise hook and loop fasteners.

12. The soccer training device of claim 1, wherein the elongated arm is selectively telescopic.

13. The soccer training device of claim 1, wherein the base member further includes a selectively sealable opening in communication with a hollow portion thereof for receiving and retaining a volume of a flowable substance to weigh down said base member.

14. The soccer training device of claim 13, wherein the flowable substance is selected from the group consisting of a liquid, a particulate solid and combinations thereof.

15. The soccer training device of claim 1, wherein the raised area of said base member further includes a plurality of selectively removable successively juxtaposed sections for permitting a desired extent of lateral movement of said elongated arm in a horizontal plane relative to said base member, thereby permitting movement in multiple planes.

16. The soccer training device of claim 15, wherein said strike plate and said mounting member are configured for permitting removal of said strike plate from said mounting member.

17. The soccer training device of claim 16, further including a plurality of strike plates each having a different width, for permitting selection of a strike plate for use having a width sufficient to accommodate the extent of lateral movement concurrent with transverse movement of said elongated arm with said soccer ball.

18. A soccer training device for enhancing ball-handling and physical coordination of a soccer player, comprising:

a circular base member having a selectively sealable opening in communication with a hollow portion thereof for receiving an amount of a flowable material to weigh down said base member;

a rotary bearing;

an elongated arm having a free distal end and a proximal end pivotally attached to a top portion of the base member via said rotary bearing, said elongated arm adapted for pivotal movement in a select axis of direction about the point of attachment to provide a range of motion of about 180 degrees in the vertical plane;

an articulated member extending from the distal end of the elongated arm, said articulated member adapted for movement from a rest position in any axis of direction independent of the elongated arm;

biasing means operatively associated with the articulated member for biasing the articulated member into alignment with the elongated arm; and ball retaining means operatively associated with the free end of the articulated member for retaining a soccer ball thereon wherein the top portion of the base member further comprises a raised area defining a groove extending laterally across the top portion thereof in alignment with a path of movement of the elongated arm, and wherein the raised area of said base member further comprises at least one removable section to permit lateral movement of the elongated arm in a horizontal plane relative to the base member.

* * * * *